US009016649B2

(12) United States Patent
Nolle

(10) Patent No.: US 9,016,649 B2
(45) Date of Patent: Apr. 28, 2015

(54) MOVABLE DEVICE FOR HOLDING REELS AND SPOOLS

(71) Applicant: Jon S. Nolle, Thompson, CT (US)

(72) Inventor: Jon S. Nolle, Thompson, CT (US)

( * ) Notice: Subject to any disclaimer, the term of this patent is extended or adjusted under 35 U.S.C. 154(b) by 0 days.

(21) Appl. No.: 14/222,602

(22) Filed: Mar. 22, 2014

(65) Prior Publication Data

US 2014/0284417 A1 Sep. 25, 2014

Related U.S. Application Data

(60) Provisional application No. 61/804,306, filed on Mar. 22, 2013.

(51) Int. Cl.

| | |
|---|---|
| ***A47F 5/00*** | (2006.01) |
| ***B65H 49/26*** | (2006.01) |
| ***B65H 49/32*** | (2006.01) |
| ***B65H 54/54*** | (2006.01) |
| ***B65H 59/04*** | (2006.01) |

(52) U.S. Cl.

CPC ..... *B65H 49/26* (2013.01); *B65H 49/327* (2013.01); *B65H 54/543* (2013.01); *B65H 59/04* (2013.01)

(58) Field of Classification Search

CPC ..... B65H 59/04; B65H 49/26; B65H 49/327; B65H 54/543

USPC ..... 248/201, 217.1, 217.3, 248, 309.2; 242/129, 139, 597.8

See application file for complete search history.

(56) References Cited

U.S. PATENT DOCUMENTS

| | | | | |
|---|---|---|---|---|
| 3,837,597 | A * | 9/1974 | Bourhenne | 242/129 |
| 5,690,301 | A | 11/1997 | Shelton et al. | |
| 6,367,754 | B1 | 4/2002 | Cinker | |
| 6,517,032 | B1 * | 2/2003 | Gretz | 248/69 |
| 6,634,592 | B1 * | 10/2003 | Berousek | 242/594.3 |
| 7,306,185 | B1 * | 12/2007 | Miller | 242/592 |
| 7,341,229 | B1 | 3/2008 | Flowers | |

OTHER PUBLICATIONS

"Licensed Electrician.com", http://www.licensedelectrician.com/Store/RT/CableStik.htm, Visited Feb. 2014.

"Altex Computers Electronics", http://www.altex.com/Wire-Reel-Holder-for-2x4-Stud-WH24-P154482.aspx, Visited Feb. 2014.

"All Data Resource", http://www.alldataresource.com/Labor-Savings-Devices-REELEZ-Portable-Wall-Stud-Cable-Spool-Holder_p_145752, Visited Feb. 2014.

* cited by examiner

*Primary Examiner* — Gwendolyn W Baxter

(74) *Attorney, Agent, or Firm* — Bowditch & Dewey, LLP; Roger P. Zimmerman

(57) ABSTRACT

A device is provided that is adapted for mounting on a vertical support, such as a stud at a construction job site, to hold a spool of wire off the floor, allowing the wire to be dispensed easily, yet providing sufficient drag on the reel to avoid excess unspooling of the wire. The device is adapted for mounting on a stud or comparable vertical support without the use of tools or fasteners so it can be moved quickly from location to location. The device is conveniently disassembled into two smaller assemblies for storage and transport to the job site.

20 Claims, 9 Drawing Sheets

MOVABLE DEVICE FOR HOLDING REELS AND SPOOLS

CROSS-REFERENCE TO RELATED APPLICATIONS

This application claims the benefit under 35 U.S.C. §119 (e) of U.S. Provisional Application Ser. No. 61/804,306, filed Mar. 22, 2013, the contents of which are hereby incorporated by reference.

BACKGROUND OF THE INVENTION

1. Field of the Invention

The disclosure relates to devices for dispensing wire, cable, flexible tubing and the like from a reel or spool. In particular, the disclosure relates to devices for holding at least one spool and dispensing wire, cable, flexible tubing and the like from a spool in a construction site.

2. Description of the Background

Typically, during construction or remodeling of a building, wire, cables, cords and hoses (referred to collectively herein as "wire") will need to be run. The wire typically is held on a spool or reel (referred to collectively herein as "spool"). There are many known devices and methods for holding the spool and dispensing the wire. The typical method used by contractors is to mount a section of pipe horizontally across two studs, with the pipe running through the central channel of the spool as an axle, so that the spool is held up off the ground and wire can be dispensed (or "unspooled") as the spool turns freely. However, this approach has three main drawbacks; (1) the wire often kinks, jamming the spool so that it does not spin easily, (2) a full spool of wire can develop momentum and continue to dispense excess wire after the operator has stopped pulling on the wire and (3) moving the spool to a different area of the job site is difficult because the pipe needs to be unfastened from the studs in order to be moved.

There are several known devices for holding reels or spools and dispensing wire, but many of these devices have drawbacks. One example of such a device is a reel holder that sits on the floor. This device not only creates a tripping hazard at the job site, but often it is difficult to make the device dispense wire freely.

SUMMARY OF THE INVENTION

A device is provided that is adapted for mounting on a vertical support, such as a stud at a construction job site, to hold a spool of wire off the floor, allowing the wire to be dispensed easily, yet providing sufficient drag on the reel to avoid excess unspooling of the wire. The device is adapted for mounting on a stud or comparable vertical support without the use of tools or fasteners so it can be moved quickly from location to location. The device is conveniently disassembled into two smaller assemblies for storage and transport to the job site.

In certain embodiments the device comprises a straight assembly 150 having a first end 154, a second end 152, a longitudinal axis 184; junction region 156 adjacent to the second end 152, and adapted to be joined to an angled assembly 110 having a first end 112 and a second end 114, a junction region 122 adjacent to the first end 112 adapted to be joined to the junction region 156 of straight assembly 150, an angled section 118 between the first end 112 and the second end 114, a short straight section 120 between the first end 112 and the angled section 118, wherein the short straight section 120 has a longitudinal axis, a long straight section 116 between the angled assembly 118 and the second end 114, the angled assembly 110 is affixed to a first curved bracket 130 having a first end 131, a second end 132, a short arm 135, a long arm 136, an outer surface 133 and an inner surface 134 and a second curved bracket 140 having a first end 141, a second end 142, a short arm 145, a long arm 146, an outer surface 143 and an inner surface 144; wherein the long straight section 116 has a longitudinal axis 182 and wherein the longitudinal axis 184 of the straight assembly 150 is at an angle beta 186 to the longitudinal axis 182 of the long straight section 116.

In certain embodiments, when the straight assembly 150 is joined to the angled assembly 110, the angle between the longitudinal axis 184 of the straight assembly and the longitudinal axis of the short straight section 120 is less than about 15 degrees, preferably less than 10, more preferably less than about 7 degrees. Typically, when the straight assembly 150 is joined to the angled assembly 110, the opening defined by the first end 131 and the second end 132 of the first curved bracket 130 faces in the same direction as the first end 154 of the straight assembly. The short arm 135 of the first curved bracket 130 and the short arm 145 of the second curved bracket 140 are attached to the angled assembly 110 by a weld or a fastener. Generally, the first curved bracket 130 and the second curved bracket 140 are affixed on the same side of the long straight section 116. Typically, the angle beta is about 95 to about 105 degrees, preferably about 97 to about 99 degrees.

In certain embodiments, the straight assembly 150 further comprises an end cap 190, holes 162 and a reel retention fastener 164. Typically, the device of claim 1 wherein the angled assembly 110 further comprises an end cap or plug 190.

The junction regions 122 and 156 each have an outer surface and an inner surface and an outer diameter and an inner diameter. In certain embodiments, the inner diameter of the junction region 156 is larger than the outer diameter of junction region 122. In certain embodiments, the junction region 156 defines a hole 160 and the junction region 122 defines a hole 126, and further comprises a button 124. In preferred embodiments, button 124 is spring-loaded.

In other embodiments, the inner surface of junction region 156 is threaded. In certain embodiments, the inner surface of junction region 122 is threaded. In embodiments in which the inner diameter of the junction region 156 is larger than the outer diameter of junction region 122, the outer surface of junction region 122 is threaded. In other embodiments in which the inner surface of junction region 156 is threaded and the inner surface of junction region 122 is threaded, the device further comprising a hollow cylindrical connector 170 having a first end and a second end, an inner surface and an outer surface, wherein the outer surface is threaded. In certain embodiments, the threaded connector 170 is threaded only on the first end and the second end is permanently affixed to junction region 122 or 156. In such embodiments, the mating junction region 156 or 122, respectively, is threaded on its inner surface. In such embodiments, device 100 is assembled by screwing the angled assembly 110 to the straight assembly 150 using the threaded first end of threaded connector 170.

In other embodiments, the invention provides a device for holding a spool for dispensing wire comprising a straight assembly 150 having a first end 154, a second end 152, a longitudinal axis 184; junction region 156 adjacent to the second end 152, joined to an angled assembly 110 having a first end 112 and a second end 114, a junction region 122 adjacent to the first end 112 adapted to be joined to the junction region 156 of straight assembly 150, an angled section 118 between the first end 112 and the second end 114, a short straight section 120 between the first end 112 and the angled section 118, wherein the short straight section 120 has a longitudinal axis, a long straight section 116 between the angled assembly 118 and the second end 114, the angled assembly 110 is affixed to a first curved bracket 130 having a first end 131, a second end 132, a short arm 135, a long arm 136, an outer surface 133 and an inner surface 134 and a second curved bracket 140 having a first end 141, a second end 142, a short arm 145, a long arm 146, an outer surface 143 and an inner surface 144; wherein the first curved bracket and the second curved bracket are adapted to grasp a substantially vertical wooden stud and support the device when it is in use. When the device is installed for use on a wooden stud wherein angle alpha 188 between the longitudinal axis 184 of the straight assembly and the vertical is less than about 90 degrees, preferably about 75 to about 85 degrees.

The above described and other features are exemplified by the following drawings and the detailed description.

BRIEF DESCRIPTION OF THE DRAWINGS

The foregoing and other features and advantages will be apparent from the following more particular description of exemplary embodiments of the disclosure, as illustrated in the accompanying drawings, in which like reference characters refer to the same parts throughout the different views. The drawings are not necessarily to scale, emphasis instead being placed upon illustrating the principles of the disclosure.

DETAILED DESCRIPTION OF PREFERRED EMBODIMENTS

Figure 1:
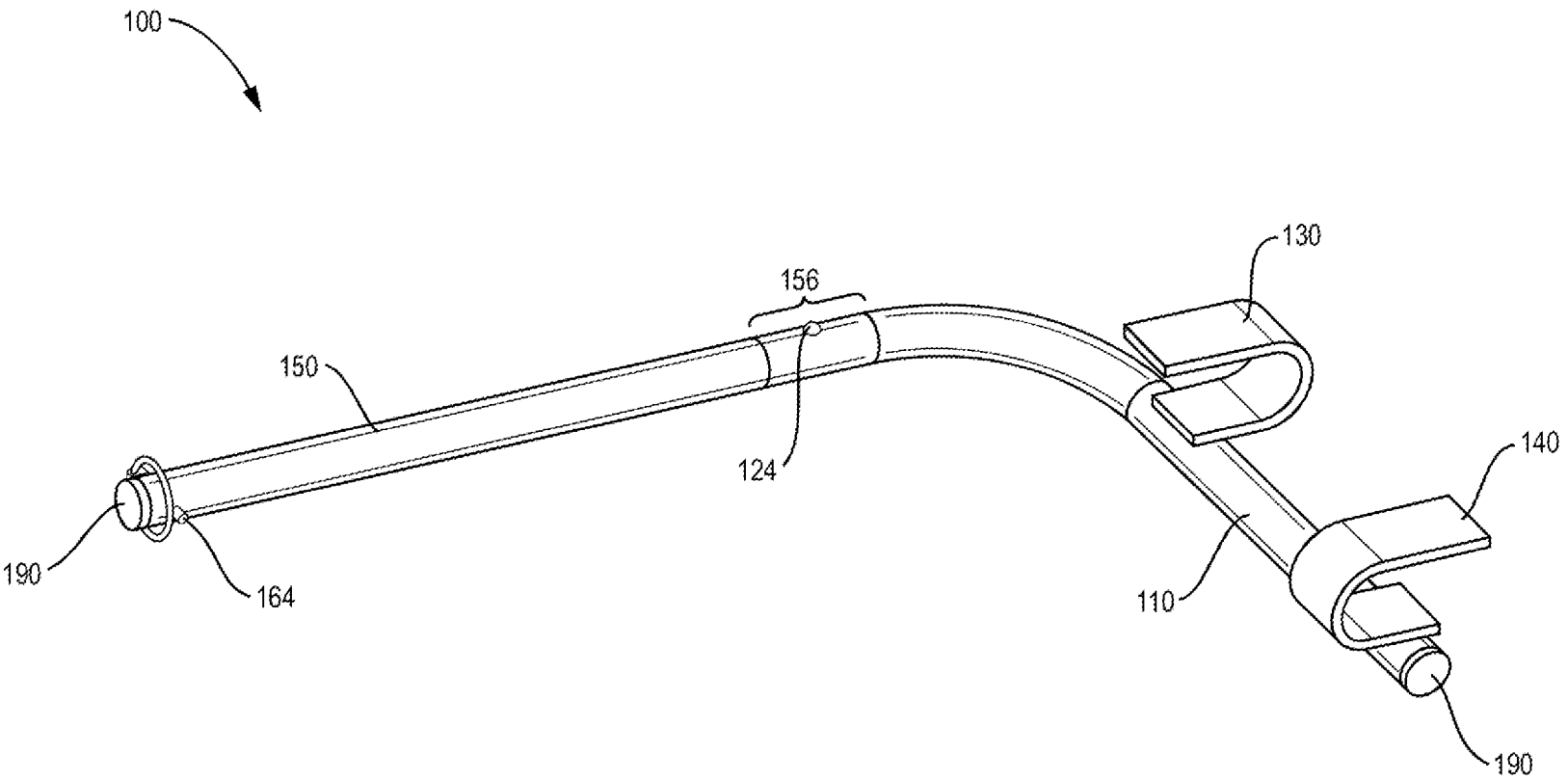
FIG. 1 is a perspective view showing an exemplary embodiment of the device 100 in an assembled state, illustrating the angled assembly 110 joined to the straight bar assembly 150, and an illustration of one embodiment of a junction 156 between the straight assembly 150 and the angled assembly 110.

FIG. 1 is a perspective view showing an exemplary embodiment of the device 100 in an assembled state, illustrating the angled assembly 110 joined to the straight bar assembly 150. In the assembled state the present invention contains various components. In the assembled state the device is configured to be affixed to stud or other vertical support by means of a first curved bracket 130 and a second curved bracket 140 positioned below the first curved bracket 130. First curved bracket 130 and second curved bracket 140 are affixed to the angled assembly 110. In preferred embodiments, the first curved bracket 130 and the second curved bracket 150 are welded to the long straight section 116. See FIGS. 2 and 3 for details. While welding is a preferred method for attaching the brackets 130 and 140 to the angled assembly 110, other methods may also be used including, but not limited to, fasteners such as nuts and bolts, machine screws in tapped holes, self-threading screws, rivets, etc. In other preferred embodiments, brackets 130 and 140 may be affixed to the angled assembly 110 by forging or casting.

In the assembled state, the device 100 is adapted for positioning on a stud using the first curved bracket 130 and the second curved bracket 140 attached to an angled assembly 110. In preferred embodiments, the device can be installed and used without using a fastener. Once installed on the stud, the straight assembly 150 will be positioned in roughly perpendicular to the stud. In preferred embodiments, the angle alpha 188 between the longitudinal axis 184 of straight assembly 150 and vertical 180 will be less than about 90 degrees, and the straight assembly 150 is angled slightly upwards. In preferred embodiments, and angle alpha 188 is about 75 to about 85 degrees. This angle helps keep a spool of wire in position on the straight assembly 150 as the cable or wire is unspooled or dispensed. In addition, the upward angle of the straight assembly 150 also allows for better control of the spinning speed of the spool by allowing the spool to rub slightly against the supporting stud to provide drag. As used herein, "drag" means that a portion of the spool of wire loaded on the device contacts the stud with sufficient friction to require that force is applied to the wire to cause unspooling of the wire.

Figure 4:
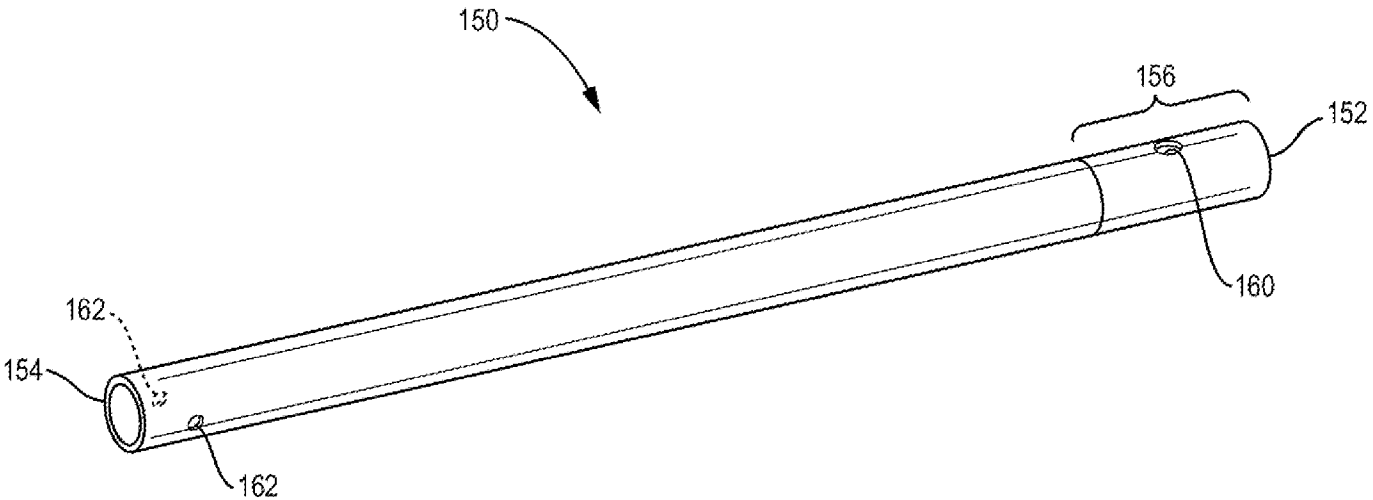
FIG. 4 is a perspective view of part of an unassembled straight bar assembly 150.

The spool is installed on the device 100 by passing the straight assembly 150 through the center channel of the reel hub to serve as an axle or spindle for the rotation of the spool during the unspooling of the wire. Once the reel is installed on the device 100, a reel retention fastener 164 is installed in holes 162. See FIGS. 1, 2, and 4. Suitable reel retention fasteners include, but are not limited to, lynch pins, circle cotter pins, R-pins or hair-pin cotter pins. In certain embodiments in which the device comprises tubing, end caps 190 can be used. As used herein, "end caps" includes plugs.

The device can be constructed of tube stock or bar stock. In preferred embodiments, the device is constructed from tube stock. The device can comprise a metal, a composite or an engineering plastic. Suitable metals include steel, steel alloys such as stainless steel, aluminum, aluminum alloys, copper, brass, magnesium and magnesium alloys. Composites include fiberglass and carbon fiber composites. Engineering plastics include acrylonitrile butadiene styrene (ABS), nylon 6, nylon 6-6, polyamides (PA), polybutylene terephthalate (PBT), polycarbonates (PC), polyetheretherketone (PEEK), polyetherketone (PEK), polyethylene terephthalate (PET), polyimides, polyoxymethylene plastic (POM/Acetal), polyphenylene sulfide (PPS), polyphenylene oxide (PPO), polysulphone (PSU), polytetrafluoroethylene (PTFE/TEFLON®), polyvinyl chloride (PVC), and ultra-high-molecular-weight polyethylene (UHMWPE/UHMW). One of ordinary skill can use any or all of metals, composites or engineering plastics as needed in construction of the device 100. In preferred embodiments, the device comprises steel tubing.

Figure 2:
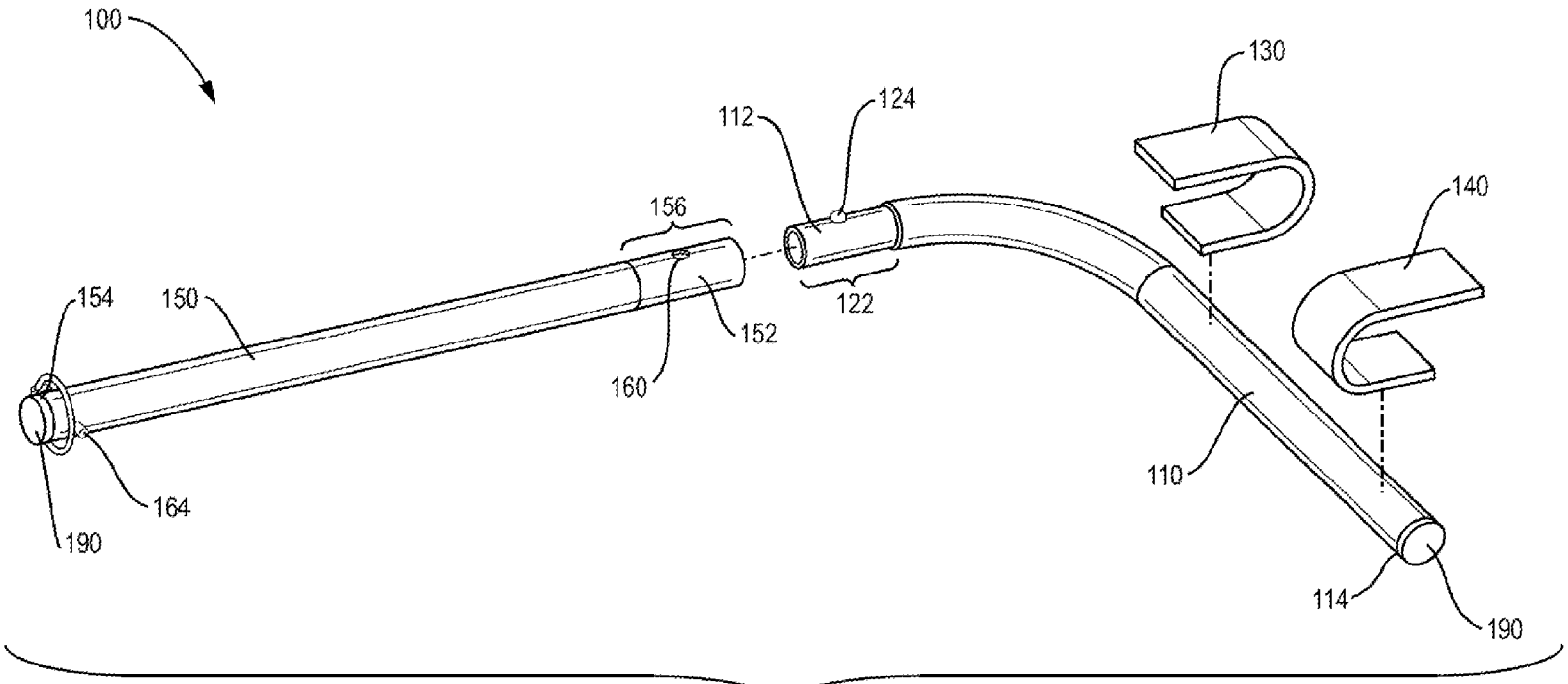
FIG. 2 is an exploded perspective view showing the exemplary embodiment of the device 100 in an unassembled state with the straight bar assembly 150 separated from the angled assembly 110, and the first curved bracket 130 and the second curved bracket 140 separate from the rest of the angled assembly 110.
Figure 3:
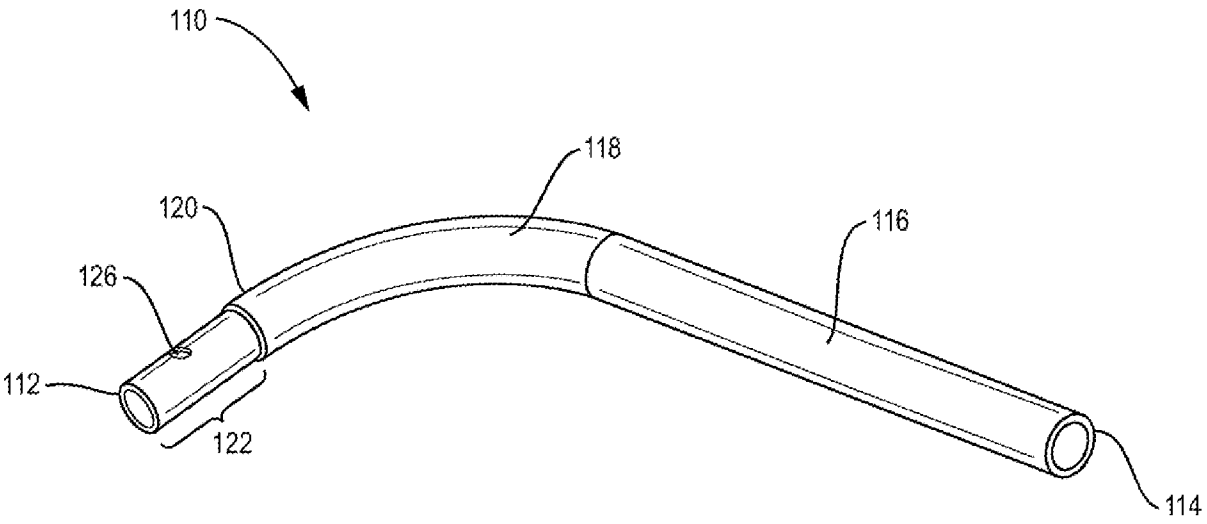
FIG. 3 is a perspective view of part of an unassembled angled assembly 110, showing the long straight section 116, the short straight section 120 and the angled section 118.

FIG. 2 is an exploded perspective view showing an exemplary embodiment of the device 100 in an unassembled state with the straight bar assembly 150 separated from the angled assembly 110, and the first curved bracket 130 and the second curved bracket 140 separate from the rest of the angled assembly 110. The straight assembly 150 has a first end 154, a second end 152 and a junction region 156 adjacent to the second end. The second end 152 of the straight assembly 150 is connected to the angled assembly 110 at junction region 156.

The angled assembly 110 has a first end 112 and a second end 114. The first end 112 is adjacent to the corresponding junction region 122. Junction region 156 and junction region 122 are connected together to assemble device 100.

There are several suitable methods for connecting the straight assembly 150 to the angled assembly 110. One embodiment is illustrated in FIG. 2, in which the inner diameter of junction region 156 is larger than the outer diameter of junction region 122. The outer diameter in junction region 122 can be reduced by known methods appropriate to the materials used. For example, the diameter of steel tubing can be reduced by swaging. The straight assembly 150 is joined to the angled assembly 110 by inserting junction region 122 into junction region 156 and securing the connection by aligning the hole 160 until pin 124 until it is seated in hole 160.

Figure 8A:
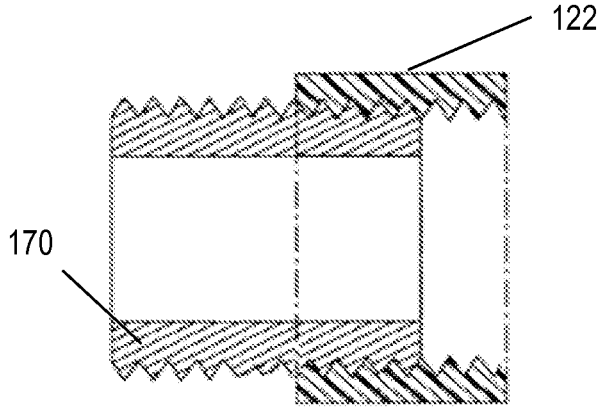
FIG. 8A and FIG. 8B are longitudinal section views of another embodiment of a junction between straight assembly 150 and angled assembly 110, showing in FIG. 8A a threaded portion of the junction region 122 of the angled assembly joined to a threaded connector 170, and in FIG. 8B, a threaded portion of the junction region 156 of the straight assembly positioned onto the thread connector 170 to join the junction portion 156 of the straight assembly to the junction portion 122 of the angled assembly.
Figure 8B:
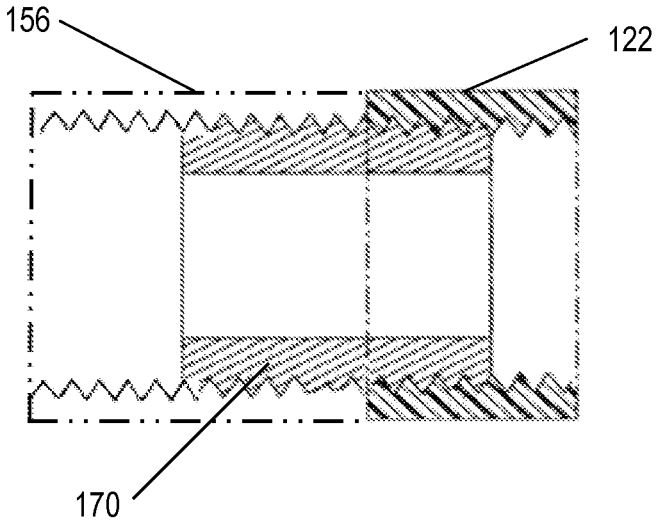
Figure 9:
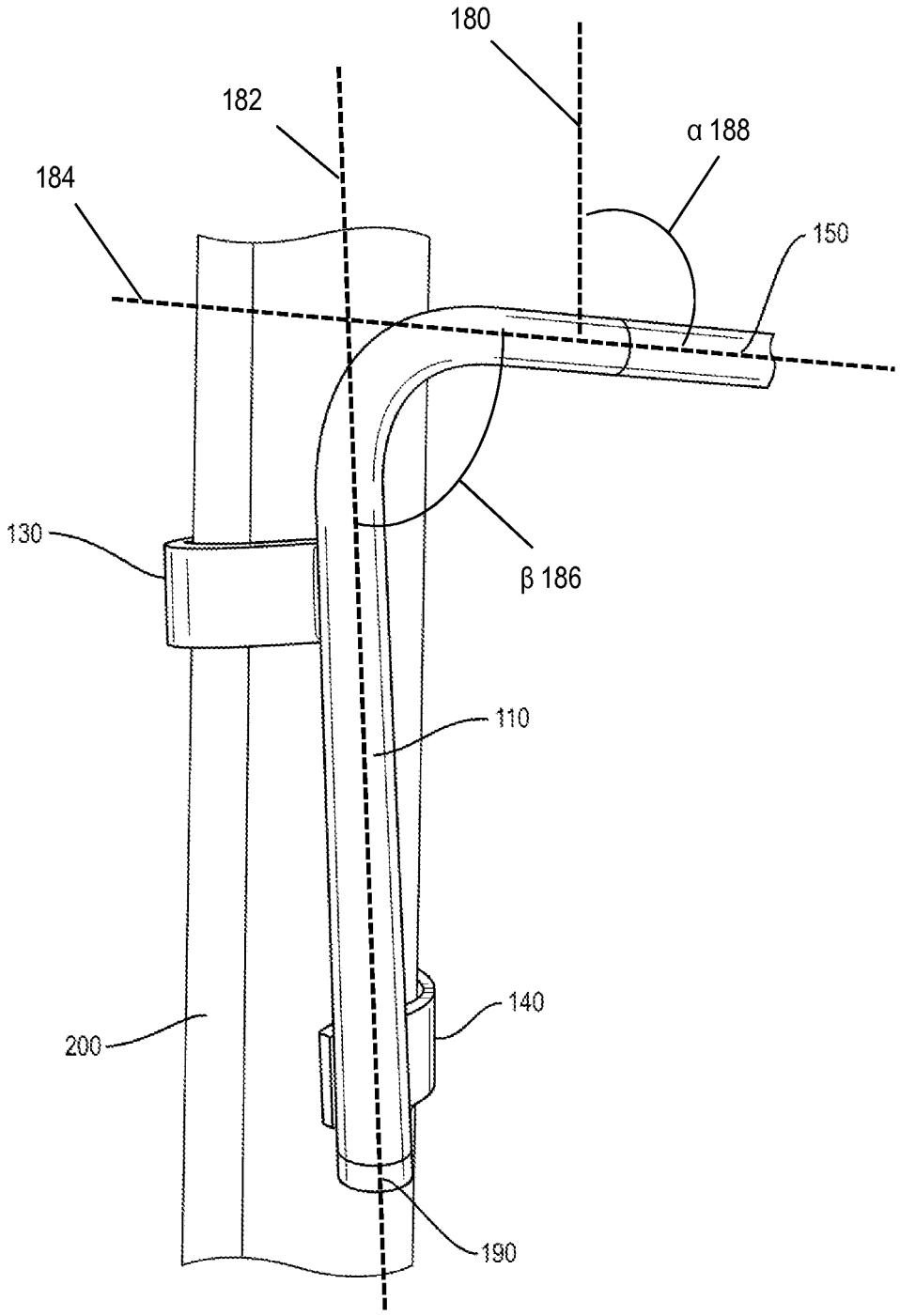
FIG. 9 is the perspective view of FIG. 7, schematically illustrating the relationships between a vertical line 180, the longitudinal axis 182 of the long straight section of the angled assembly 110, the longitudinal axis 184 of the straight assembly 150, the angle a 188 between the vertical line 180 and the longitudinal axis 184 of the straight assembly 150, and the angle 186 between the longitudinal axis 184 of the straight assembly 150 and the longitudinal axis 182 of the long straight section of the angled assembly 110.

Another embodiment is shown in FIG. 8A and FIG. 8B. FIG. 8A and FIG. 8B are longitudinal section views showing in FIG. 8A a threaded portion of the junction region 122 of the angled assembly joined to a threaded connector 170, and in FIG. 8B, a threaded portion of the junction region 156 of the straight assembly positioned onto the threaded connector 170 to join the junction portion 156 of the straight assembly to the junction portion 122 of the angled assembly.

Figure 5:
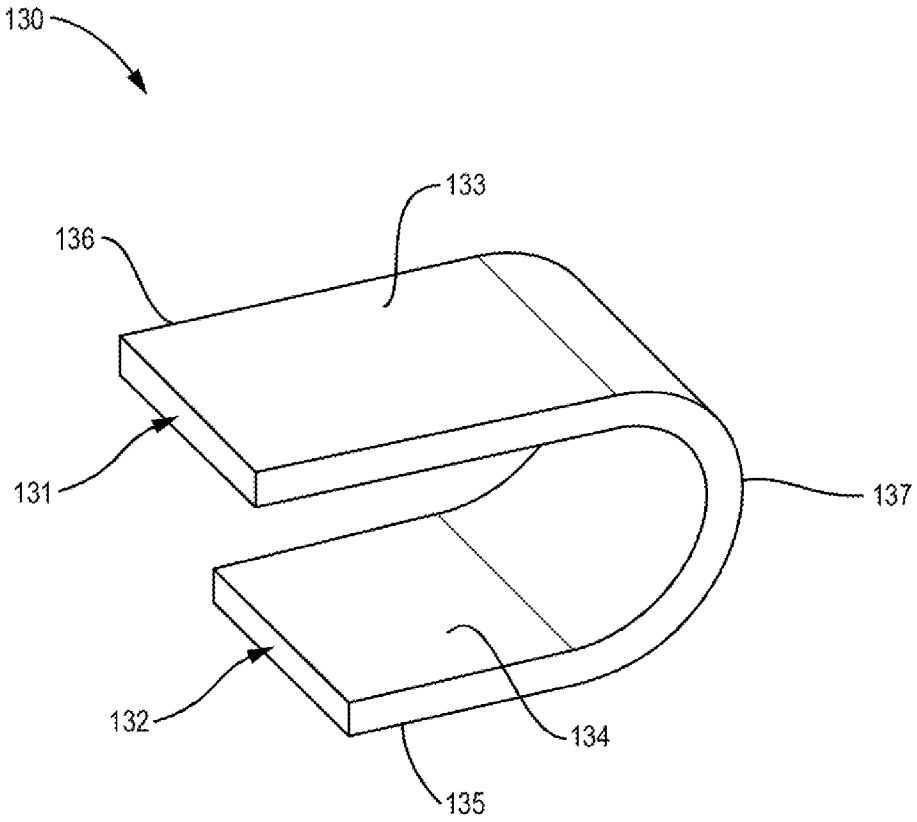
FIG. 5 is a perspective view showing details of the first curved bracket 130.
Figure 6:
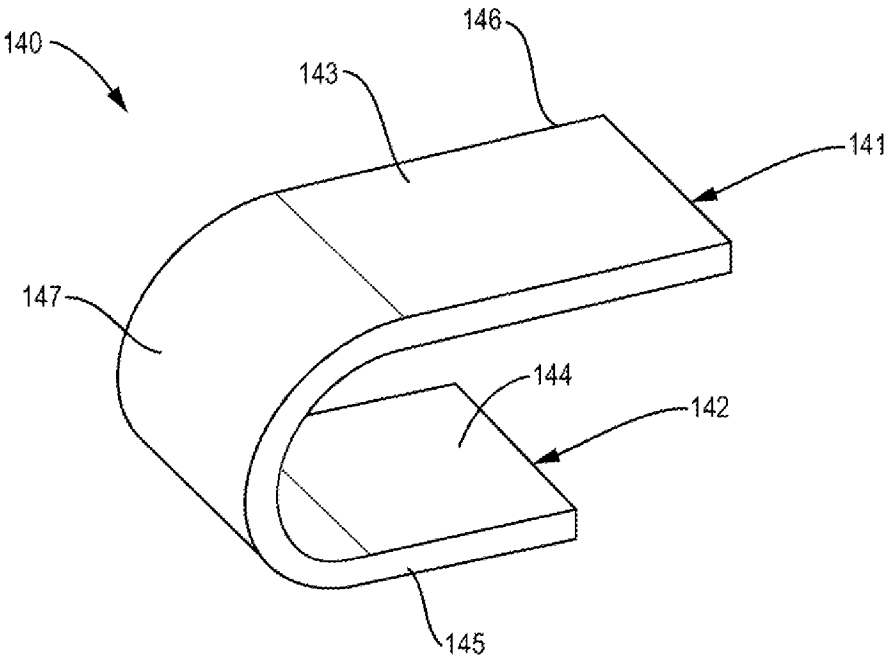
FIG. 6 is a perspective view showing details of the second curved bracket 140.
Figure 7:
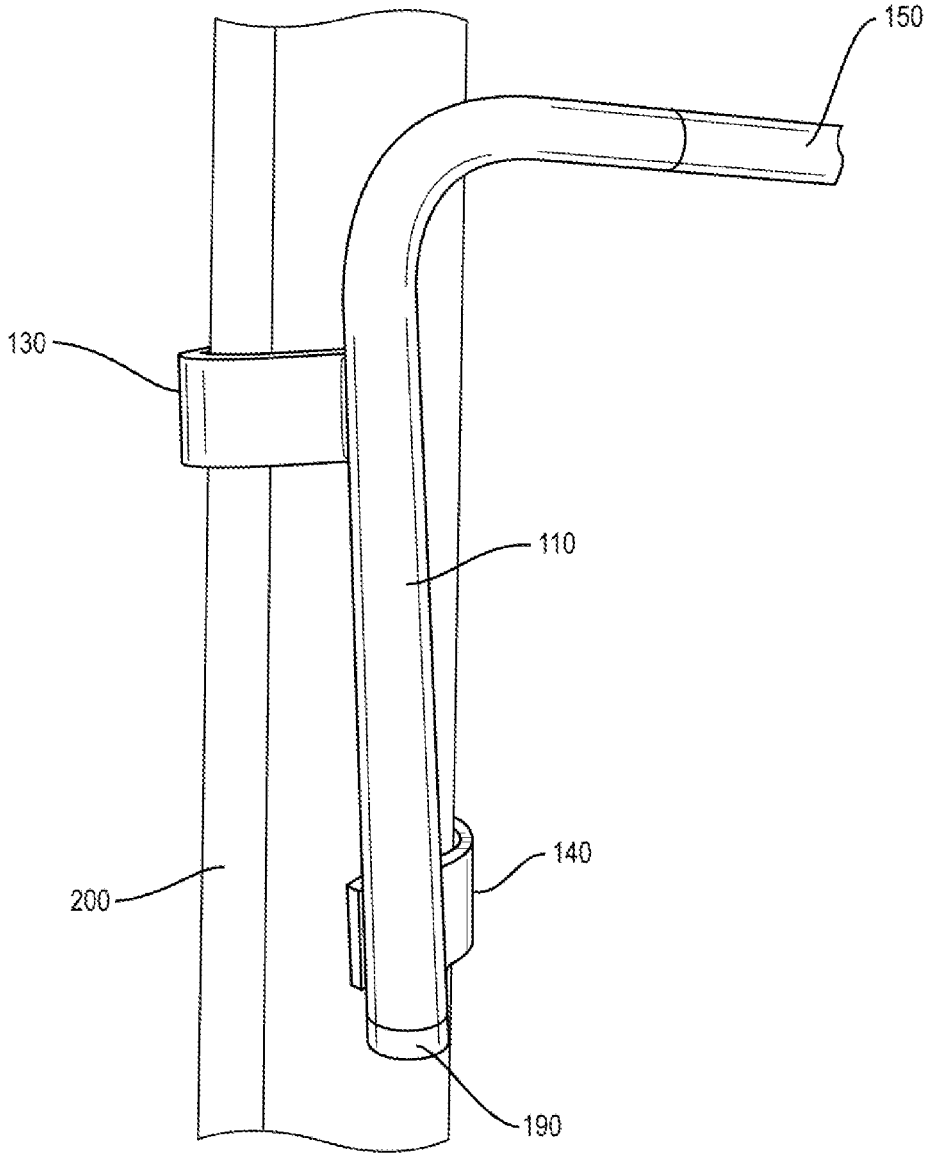
FIG. 7 is a perspective view of an exemplary embodiment of the device installed on a supporting stud of dimensional lumber 200 at a construction site for use, showing the straight bar assembly 150, the angled assembly 110 including the first curved bracket 130, and the second curved bracket 140 in relation to the supporting wooden stud 200.

FIG. 5 and FIG. 6 illustrate a perspective view showing the details of first curved bracket 130 and second curved bracket 140, respectively. These two brackets are identical, but mounted spaced apart along the length of the long straight section 116 with the open ends directed in opposite directions so as to grasp the stud. The first curved bracket 130 has a first end 131, a second end 132, a short arm 135, a long arm 136, an outer surface 133, an inner surface 134 and a curved section 137. The second curved bracket 140 has a first end 141, a second end 142, a short arm 145, a long arm 146, an outer surface 143, an inner surface 144 and a curved section 147. In certain embodiments, short arms 135, 145 and long arms 136, 146 can be of equal length.

The first curved bracket 130 and the second curved bracket 140 should be positioned on the long straight section 116 of the angled assembly 110. The first curved bracket 130 and second curved bracket 140 should be spaced apart from one another with the inner surface 134 of curved section 137 and the inner surface 144 of curved section 147 facing horizontally in opposite directions, that is viewed from the longitudinal axis 182.

In an embodiment, first curved bracket 130 and second curved bracket 140 are sized to fit onto a standard two by four dimensional wooden stud. The size of the bracket may be selected to fit different size studs and vertical supports. Both first curved bracket 130 and second curved 140 comprise curved sections 137, 147 that are rounded and adapted to grip the stud tightly. The added weight of placing the reel on straight bar assembly 150 further wedges the stud into this curved sections 137, 147 to reduce the likelihood of the device slipping down the stud.

While the disclosure has been described with reference to an exemplary embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

The invention claimed is:

1. A device comprising:

a straight assembly (150) having a first end (154), a second end (152), a longitudinal axis (184); junction region (156) adjacent to the second end (152), and adapted to be joined to an angled assembly (110) having a first end (112) and a second end (114), a junction region (122) adjacent to the first end (112) adapted to be joined to the junction region (156) of the straight assembly (150), an angled section (118) between the first end (112) and the second end (114), a short straight section (120) between the first end (112) and the angled section (118), wherein the short straight section (120) has a longitudinal axis, a long straight section (116) between the angled assembly (118) and the second end (114), the angled assembly (110) is affixed to a first curved bracket (130) having a first end (131), a second end (132), a short arm (135), a long arm (136), an outer surface (133) and an inner surface (134) and a second curved bracket (140) having a first end (141), a second end (142), a short arm (145), a long arm (146), an outer surface (143) and an inner surface (144);

wherein the long straight section (116) has a longitudinal axis (182) and wherein the longitudinal axis (184) of the straight assembly (150) is at an angle beta (186) to the longitudinal axis (182) of the long straight section (116).

2. The device of claim 1 wherein when the straight assembly (150) is joined to the angled assembly (110), the angle between the longitudinal axis (184) of the straight assembly and the longitudinal axis of the short straight section (120) is less than 15 degrees.

3. The device of claim 1 wherein when the straight assembly (150) is joined to the angled assembly (110), the angle between the longitudinal axis (184) of the straight assembly and the longitudinal axis of the short straight section (120) is less than 10 degrees.

4. The device of claim 1 wherein when the straight assembly (150) is joined to the angled assembly (110), the opening defined by the first end (131) and the second end (132) of the first curved bracket (130) faces in the same direction as the first end (154) of the straight assembly.

5. The device of claim 1 wherein the short arm (135) of the first curved bracket (130) and the short arm (145) of the second curved bracket (140) are attached to the angled assembly (110), by a weld or a fastener.

6. The device of claim 1 wherein the first curved bracket (130) and the second curved bracket (140) are affixed on the same side of the long straight section (116).

7. The device of claim 1 wherein the angle beta is about 95 to about 105 degrees.

8. The device of claim 1 wherein the straight assembly (150) further comprises an end cap (190) holes (162) and a reel retention fastener (164).

9. The device of claim 1 wherein the angled assembly (110) further comprises an end cap (190).

10. The device of claim 1 wherein the junction regions (122) and (156) each have an outer surface and an inner surface and an outer diameter and an inner diameter.

11. The device of claim 10 wherein the inner diameter of junction region (156) is larger than the outer diameter of junction region (122).

12. The device of claim 11 wherein the junction region (156) defines a hole (160) and the junction region (122) defines a hole (126).

13. The device of claim 11 wherein the junction region (122) further comprises a button (124).

14. The device of claim 11 wherein the outer surface of the junction region (122) is threaded.

15. The device of claim 10 wherein the inner surface of the junction region (156) is threaded.

16. The device of claim 15 wherein the inner surface of the junction region (122) is threaded.

17. The device of claim 15 further comprising a hollow cylindrical connector (170) having an inner surface and an outer surface, wherein the outer surface is threaded.

18. A device for holding a spool for dispensing wire, cable, or flexible tubing comprising:

a straight assembly (150) having a first end (154), a second end (152), a longitudinal axis (184); junction region (156) adjacent to the second end (152), joined to an angled assembly (110) having a first end (112) and a second end (114), a junction region (122) adjacent to the first end (112) adapted to be joined to the junction region (156) of the straight assembly (150), an angled section (118) between the first end (112) and the second end (114), a short straight section (120) between the first end (112) and the angled section (118), wherein the short straight section (120) has a longitudinal axis, a long straight section (116) between the angled assembly (118) and the second end (114), the angled assembly (110) is affixed to a first curved bracket (130) having a first end (131), a second end (132), a short arm (135), a long arm (136), an outer surface (133) and an inner surface (134) and a second curved bracket (140) having a first end (141), a second end (142), a short arm (145), a long arm (146), an outer surface (143) and an inner surface (144);

wherein the first curved bracket and the second curved bracket are adapted to grasp a substantially vertical wooden stud and support the device when it is in use.

19. The device of claim 18 installed on the wooden stud wherein angle alpha (188) between the longitudinal axis (184) of the straight assembly and the vertical is less than about 90 degrees.

20. The device of claim 19 wherein a reel of wire loaded on the device contacts the stud with sufficient friction to require that force is applied to the wire to cause unspooling of the wire.

* * * * *